252-95 AU 166 EX
12/9/80 XR 4,238,192

United States Patent [19]
Kandathil

[11] 4,238,192
[45] Dec. 9, 1980

[54] HYDROGEN PEROXIDE BLEACH COMPOSITION

[75] Inventor: Thomas V. Kandathil, Racine, Wis.

[73] Assignee: S. C. Johnson & Son, Inc., Racine, Wis.

[21] Appl. No.: 5,127

[22] Filed: Jan. 22, 1979

[51] Int. Cl.[3] ..... D06L 3/02; C11D 3/395; C11D 3/40; C11D 3/42

[52] U.S. Cl. ..... 8/111; 252/95; 252/100; 252/102

[58] Field of Search ..... 8/111; 252/95, 100, 252/102

[56] References Cited

U.S. PATENT DOCUMENTS

| | | | |
|---|---|---|---|
| 2,022,860 | 12/1935 | Kunz | 8/111 |
| 2,081,327 | 5/1937 | Franz | 8/111 |
| 3,756,774 | 9/1973 | Kirner | 8/111 |
| 3,811,833 | 5/1974 | Stalter | 8/111 |
| 3,864,271 | 2/1975 | Stalter | 252/95 |
| 3,969,257 | 7/1976 | Murray | 252/102 |
| 3,970,575 | 7/1976 | Barrett | 252/95 |
| 4,059,678 | 11/1977 | Winkley | 252/95 |
| 4,060,385 | 11/1977 | Katz | 252/95 |
| 4,113,645 | 9/1978 | DeSimome | 252/95 |
| 4,129,517 | 12/1978 | Eggensperger et al. | 18/111 |

*Primary Examiner*—John Kight, III

[57] ABSTRACT

A stabilized liquid hydrogen peroxide bleach composition suitable for household use which comprises from 2–12% by weight hydrogen peroxide, 0–20% by weight of an acid selected from an organic acid, phosphoric acid, boric acid or mixtures thereof, 0.1–7.5% by weight of a nitrogen-containing compound, 0.0001–1% by weight of a compound selected from the group consisting of optical brighteners, dyes and mixtures thereof, and water, wherein the weight ratio of hydrogen peroxide to nitrogen-containing compound is within the range of from 1:0.003 to 1:1.5, the composition contains sufficient acid to have a pH within the range of from 1.8–5.5.

17 Claims, No Drawings

HYDROGEN PEROXIDE BLEACH COMPOSITION

BACKGROUND OF THE INVENTION

Liquid hydrogen peroxide bleaches have been known for a considerable length of time, especially in the industrial processes of treating or bleaching fibers and cloth during manufacture. These stablized compositions are primarily 35%, 50% or 70% hydrogen peroxide solutions, a commercially available commodity. In order to utilize liquid hydrogen peroxide solutions as a general-purpose home laundry bleach, the concentrated hydrogen peroxide solutions must be diluted to lower strength, i.e., within the range of from 2–12% hydrogen peroxide.

Because of the nature of the hydrogen peroxide, it tends to be more stable in concentrated solutions than it is in more diluted solutions. There have been numerous attempts to prepare stable dilute liquid hydrogen peroxide bleaching compositions which contain dyes and/or optical brighteners plus other ingredients thought necessary to prepare a commercially acceptable household laundry product. An example is U.S. Pat. No. 3,970,575, which describes a hydrogen peroxide bleaching composition utilizing one specific dye and polyethylene oxide nonionic surfactants. The particular dye described in this U.S. patent appears particularly stable in the presence of hydrogen peroxide and does not react with hydrogen peroxide or catalyze the decomposition of hydrogen peroxide. As described in this patent, however, the use of this particular dye does create some difficulty as the dye is very substantive to fabrics requiring the use of certain nonionic surfactants to remove the same so that there is no build-up.

SUMMARY OF THE INVENTION

It has been unexpectedly found that other dyes, including optical brighteners, which are normally not stable in the presence of hydrogen peroxide or catalyze the decomposition of hydrogen peroxide can be combined with hydrogen peroxide in dilute stable solution to form a composition with good textile bleaching qualities if mixed with certain nitrogen-containing compounds and if the composition has a pH of from 1.8–5.5.

OBJECTS AND ADVANTAGES

It is, therefore, the primary object of the present invention to prepare stable hydrogen peroxide liquid bleaching compositions containing normally unstable dyes.

It is a still further object of the present invention to prepare a stable hydrogen peroxide liquid bleaching composition containing optical brighteners.

It is a further object of the present invention to provide a stable aqueous dilute hydrogen peroxide laundry bleaching product which contains a dye which does not adversely build-up on laundry after repeated washing.

It is a still further object of the present invention to provide a stable hydrogen peroxide composition containing a perfume.

Still further objects and advantages of the compositions of the present invention will become more apparent from the following, more detailed description thereof.

DETAILED DESCRIPTION OF THE INVENTION

The composition of the present invention is a stable aqueous bleach composition comprising from 2–12% by weight hydrogen peroxide, 0–20% by weight of an acid selected from the group consisting of an organic acid, phosphoric acid, boric acid or mixtures thereof to bring the pH of the composition to a pH within the range of from about 1.8–5.5, from 0.05–10% by weight of at least one nitrogen-containing compound, from 0.0001–1% by weight of a compound selected from a dye, an optical brightener and mixtures thereof, and water. The ratio of the hydrogen peroxide to organic acid, if present, should be within the range of from 1:0.01–1:4, and the ratio of hydrogen peroxide to nitrogen-containing compound is within the range of from 1:0.003–1:1.5, the composition has a pH within the range from about 1.8–5.5.

The active bleaching component in the bleaching composition of the present invention is the hydrogen peroxide. This hydrogen peroxide may be any commercially available form of hydrogen peroxide which is diluted down to the proper percentage by weight. The composition can contain from 2–12% by weight hydrogen peroxide, and it is preferred that the composition contain from 2–8% and most preferred that the composition contain from 2–6% by weight hydrogen peroxide. The reason for preferring lower amounts of hydrogen peroxide is not particularly because of stability or performance, but because compositions having these lower percentages of hydrogen peroxide can be sold without special safety venting caps.

The composition of the present invention may also include an acid selected from the group consisting of organic acid, phosphoric acid, boric acid or mixtures thereof. The acid is present in an amount from 0–20% by weight of the composition to control the pH of the composition to within the range of from about 1.8–5.5. It is within this range that the $H_2O_2$ is an active bleaching species and when combined with a suitable amine-containing compound the $H_2O_2$ is stable for extended storage periods. Occasionally an acid is not required to bring the composition to within the range of 1.5–5.5, however, it is generally necessary and in fact preferred to incorporate at least one acid into the composition.

As used in this specification and in the attached claims the term "organic acid" means carboxylic acids wherein the acid functionality predominates over other groups present in the compound. This term does not include alpha-amino monocarboxylic acids but does include tetra and penta carboxylic acids containing some nitrogen.

Suitable organic acids include various saturated and unsaturated mono-, di-, tri- tetra- and pentacarboxylic acids, such as acetic acid, oxalic acid, formic acid, adipic acid, maleic acid, tartaric acid, lactic acid, gluconic acid, glucaric acid, glucuronic acid, ascorbic acid; mono- and dicarboxylic acids of benzene such as benzoic acid, phthalic acid and substituted aromatic acids and salts of these carboxylic acids such as sodium benzoate, calcium formate, calcium acetate and the like. Also certain nitrogen-containing acids are suitable for use as the organic acid. Generally these are more complex nitrogen-containing compounds with 4 or 5 caroxyl groups such as ethylene diamine tetraacetic acid or diethylene triamine pentaacetic acid. In these acids the acid functionality is more important than the amine functionality. It is preferred that the composition contain from 0.1–12% by weight and most preferably from 0.50–8% by weight of the above organic acids, phosphoric acid, boric acid or mixtures thereof. The preferred acids are adipic, phthalic, citric, boric or mixtures thereof. The most preferred acid is adipic acid. Furthermore, when the organic acid is present in the composition it must be present in a sufficient amount so that the ratio of hydrogen peroxide to organic acid is within the range of from about 1:0.01–1:4 and preferably within the range of from 1:0.01–1:2.5.

The composition of the present invention must contain from 0.05–10% by weight of at least one nitrogen-containing compound. By the term "nitrogen-containing compound" in this specification and in the attached claims is meant a composition containing amine functionality wherein the amine functionality predominates over other groups present in the molecule. Suitable nitrogen-containing compounds include ammonia, amines having the formula

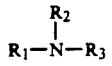

wherein $R_1$ is selected from the group consisting of an alkyl group having from 1–8 carbon atoms, a hydroxy substituted alkyl group having from 1–9 carbon atoms; $R_2$ is selected from hydrogen, an alkyl group having from 1–8 carbon atoms, and a hydroxy substituted alkyl group having from 1–9 carbon atoms; and $R_3$ is selected from hydrogen, an alkyl group having from 1–8 carbon atoms, and a hydroxy substituted alkyl group having from 1–9 carbon atoms; water-soluble aromatic primary, secondary and tertiary amines, and salts thereof, tetramethyl and tetraethyl ammonium hydroxide; water-soluble heterocycic compounds having 5 and 6 membered rings including at least one ring nitrogen. Also suitable are the water-soluble aliphatic amides having from 2–8 carbon atoms and water-soluble aromatic amides. Further suitable nitrogen-containing compounds are the monocarboxylic alpha-amino acids selected from the group consisting essentially of carbamic acid,

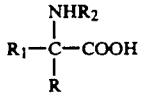

wherein R is hydrogen or methyl, $R_1$ is hydrogen; a lower alkyl group having 1–4 carbon atoms; a phenyl substituted or hydroxyphenyl substituted lower alkyl, i.e., 1–4 carbon atoms, group; a hydroxy or thio substituted lower alkyl, i.e., 1–4 carbon atoms, group; a lower alkyl, i.e., 1–4 carbon atoms; thio substituted lower alkyl, i.e., 1–4 carbon atoms, group; and an amino substituted lower alkyl, i.e., 1–4 carbon atoms, group; $R_2$ is hydrogen or hydroxyphenyl, and mixtures thereof. Representative alpha-amino acids within the above formula are glycine, alanine, valine, leucine, isovaline, isoleucine, phenylalanine, tyrosine, serine, threonine, cysteine, and methionine. It is preferred that the nitrogen-containing compound be an alpha-amino acid or a mixture of alpha-amino acids. The preferred alpha-amino acids are methionine, glycine or mixtures thereof. It is preferred that the nitrogen-containing compound be present in an amount of from 0.1–7.5% by weight, and it is most preferred that the nitrogen-containing compound be present in an amount from 0.5–1.5% by weight.

The hydrogen peroxide and nitrogen-containing compounds utilized in the composition of the present invention must be present in certain specific ratios relative to each other. The ratio of hydrogen peroxide to nitrogen-containing compound must be within the range of from about 1:0.003 to about 1:1.5, and preferably from 1:0.01–1:1.25. It is only within this relative range that the stability of the composition of the present invention is achieved.

The dye used in the present invention comprises from 0.0001–1% by weight of dye and/or optical brighteners. The following dyes are suitable: Color Index Direct Violet 9 (#27885), Color Index Acid Blue 127 (#61135), Color Index Direct Violet 48.1, Color Index Direct Blue 199 (phthalocyanine), Color Index Pigment Green 7 (#74260), Color Index Acid Blue 127-1, Color Index Acid Red 131, Color Index Acid Blue 80 (#61585), Color Index Acid Violet 48, Pergacid Bond Blue G, Color Index Acid Green 25 (#61570), Color Index Acid Blue 43 (#63000), Color Index Acid Blue 9 (#42090), Color Index Acid Violet 48, Color Index Acid Blue 147 (#42135), Tinolate Brilliant Blue GL23 (Ciba-Geigy) and the like. Suitable optical brighteners include: Color Index Fluorescent Brighteners 28, 35, 40, 61, 71, 140 and the like. Mixtures of dyes and mixtures of optical brighteners are also suitable. If desired, the composition can include at least one dye, at least one optical brightener or a mixture of at least one dye and at least one optical brightener.

The composition of the present invention comprises primarily water. Preferably the water utilized to prepare the composition of the present invention is deionized water so as to minimize the addition of metal ions which tend to catalyze the decomposition of hydrogen peroxide.

As noted previously, the composition of the present invention must have a pH within the range of 1.8–5.5. It is within this range that both the product performance and the stability of the composition are at a maximum. Further, the performance of the composition is enhanced over $H_2O_2$ at a pH outside the above range because $H_2O_2$ forms peracids when combined with carboxylic acids at a pH within the range of from 1.8–5.5. These peracids are more reactive, thereby giving greater bleach performance than $H_2O_2$ alone, or the same composition at a more basic pH.

The final concentration of peracid species must be carefully controlled for a household consumer product, as high peracid concentrations are very reactive and also unstable, which shortens shelf life and could create a dangerous situation. For this reason, the concentration of $H_2O_2$, carboxylic acid and nitrogen-containing compounds are critical to the stability and performance of the composition of the present invention.

The composition of the present invention also may optionally contain a bleach-stable surfactant to assist in removing stains. These surfactants reduce the surface tension of the stain and allow the stain to be more readily wet by the bleach. The surfactant may be any bleach-stable surfactant including nonionic, anionic, cationic and amphoteric surfactants. These surfactants may be present in an amount of from 0–7% by weight and preferably from 1–5% by weight. The preferred class of surfactants, when present, for use in the composition of the present invention are the nonionic surfactants. The most preferred surfactants are nonionic surfactants having between 6 and 12 moles of ethylene oxide per mole of alcohol, such as linear alkyl alcohols having 9 to 18 carbon atoms, secondary alkyl alcohols having 9 to 18 carbon atoms, and alkyl aryl alcohols including alkyl phenols, having 8 to 18 carbon atoms in the alkyl group.

The composition can also include other standard optional ingredients which do not adversely affect the stability of the bleach. Perfumes can be incorporated. However, care must be exercised in the solution of a perfume as these compositions are mixtures of many compounds, some of which may be susceptible to degradation by the hydrogen peroxide. Generally, less than 1% perfume is used.

The composition of the present invention can be simply prepared by blending the desired ingredients together to form an intimate mixture. Generally, it is preferred to package the composition of the present invention in plastic containers, such as polyethylene, as glass containers can produce ions which further catalyze the decomposition of hydrogen peroxide.

The composition of the present invention will now be illustrated by way of the following examples which are in no way intended to be limiting of the scope of the present invention. In the following examples, all parts and percentages are by weight and the temperatures are in degrees Centigrade.

EXAMPLE I

The following bleach formulation was prepared:

| | |
|---|---|
| Aqueous $NH_4OH$ (28%) | 1.2138 |
| DL methionine | 0.10 |
| Phthalic acid | 1.6613 |
| $H_2O_2$ (Albone 35 CG-35% stabilized) | 17.14 |
| Nonyl phenol + 9.5 EO | 3.00 |
| Perfume | 0.15 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation is prepared by blending each of the above ingredients together to form an intimate mixture. The four dyes conveniently can be dissolved as a 5:1 percent solution and added in this manner. This formulation has a pH of 4.2. The formulation was heated to 100° C. for 24 hours. At the end of this period, the sample was compared to a fresh control sample having the same perfume, dyes, and brighteners. If the perfume changed or degraded or the dye color changed, the sample was considered unstable. Also, the hydrogen peroxide level was determined, a loss of 5% or more of the hydrogen peroxide was determined unacceptable. Lastly, the composition was placed on a piece of white cotton cloth and placed under a UV lamp to determine visually if the brighteners had degraded. This accelerated 24-hour test correlates to about one year shelf stability under normal temperatures. The above formulation did not change or degrade the color or perfume, the brighteners had not degraded and the loss of hydrogen peroxide was less than 5%.

EXAMPLE II

The following bleach formulation was prepared:

| | |
|---|---|
| Aqueous $NH_4OH$ (28%) | 12.134 |
| DL methionine | 0.10 |
| Phthalic acid | 16.613 |
| $H_2O_2$ (35%-Albone 35 CG) | 17.14 |
| Nonyl Phenol + 9.5 EO | 3.00 |
| Perfume | 0.15 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 4.6. Furthermore, when tested using the accelerated stability test of Example I at a temperature of 100° C., the product has not changed color or degraded the perfume and brightener after 1 day, and the hydrogen peroxide loss was less than 5%, indicating that the shelf stability of the formula will be about 12 months.

EXAMPLE III

The following bleach formulation was prepared:

| | |
|---|---|
| Aqueous $NH_4OH$ (28%) | 1.8207 |
| DL methionine | 0.1000 |
| Citric acid | 1.9212 |
| $H_2O_2$ (Albone 35 CG-35% stabilized) | 17.1400 |
| Nonyl phenol + 9.5 EO | 3.0000 |
| Perfume | 0.1500 |
| Polar Brilliant Blue GAW Crude (CI Acid Blue 127-1) | 0.04794 |
| Chloramine Brilliant Violet B Concentrate (CI Direct Violet 9) | 0.000165 |
| Tinopal CBS (CI Fluorescent Brightener 35) | 0.1000 |
| Tinopal SWN (CI Fluorescent Brightener 140) | 0.0500 |
| Deionized water | qs to 100% |

The above formulation was prepared using the procedure of Example I and had a pH of 5.2. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE IV

The following bleach formulation was prepared:

| | |
|---|---|
| Aqueous $NH_4OH$ (28%) | 18.207 |
| DL methionine | 0.100 |
| Citric acid | 19.212 |
| $H_2O_2$ (Albone 35 CG-35% stabilized) | 17.140 |
| Nonyl phenol + 9.5 EO | 3.000 |
| Perfume | 0.150 |
| Polar Brilliant Blue GAW Crude (CI Acid Blue 127-1) | 0.001794 |
| Chloramine Brilliant Violet B | |

-continued

| | |
|---|---|
| Concentrate (CI Direct Violet 9) | 0.000165 |
| Tinopal CBS (CI Fluorescent Brightener 35) | 0.100 |
| Tinopal SWN (CI Fluorescent Brightener 140) | 0.050 |
| Deionized water | qs to 100% |

The above formulation was prepared using the procedure of Example I and had a pH of 5.1. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE V

The following bleach formulation was prepared:

| | |
|---|---|
| DL methionine | 0.10 |
| Adipic acid | 0.14619 |
| $H_2O_2$ (Albone 35 CG-35% stabilized) | 17.14 |
| Nonyl phenol + 9.5 EO | 3.00 |
| Perfume | 0.15 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 2.8. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE VI

The following bleach formulation was prepared:

| | |
|---|---|
| DL methionine | 0.10 |
| Adipic acid | 1.4619 |
| $H_2O_2$ (Albone 35 CG-35% stabilized) | 17.14 |
| Nonyl phenol + 9.5 EO | 3.00 |
| Perfume | 0.15 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 1.9. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPE VII

The following bleach formulation was prepared:

| | |
|---|---|
| Aqueous $NH_4OH$ (28%) | 12.138 |
| DL methionine | 0.10 |
| Adipic acid | 14.619 |
| $H_2O_2$ (Albone 35 CG-35% stabilized) | 17.14 |
| Nonyl phenol + 9.5 EO | 3.00 |
| Perfume | 0.15 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 4.9. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE VIII

The following bleach formulation was prepared:

| | |
|---|---|
| Triethanol amine | 7.4595 |
| $H_2O_2$ (Albone 35 CG-35% stabilized) | 17.14 |
| Nonyl phenol + 9.5 EO | 3.00 |
| Perfume | 0.15 |
| Diethylene triamine pentacetic acid | 3.93 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 5.5. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE IX

The following bleach formulation was prepared:

| | |
|---|---|
| DL methionine | 0.10 |
| Triethanol amine | 7.4595 |
| $H_2O_2$ (Albone 35 CG-35% stabilized) | 17.14 |
| Nonyl phenol + 9.5 EO | 3.00 |

-continued

| | |
|---|---|
| Perfume | 0.15 |
| Diethylenetriamine pentacetic acid | 3.95 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 5.4. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE X

The following bleach formulation was prepared:

| | |
|---|---|
| Citric acid | 1.9212 |
| Isopropyl amine | 1.7724 |
| $H_2O_2$ (Albone 35 CG-35% stabilized) | 17.14 |
| Nonyl phenol + 9.5 EO | 3.00 |
| Perfume | 0.15 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 4.9. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE XI

The following bleach formulation was prepared:

| | |
|---|---|
| Boric acid | 0.6184 |
| $H_2O_2$ (Albone 35 CG-35% stabilized) | 17.14 |
| Nonyl phenol + 9.5 EO | 3.00 |
| Perfume | 0.15 |
| Glycine | 0.10 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | gs to 100% |

The above formulation was prepared using the procedure of Example I and had a pH of 5.0. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE XII

The following bleach formulation was prepared:

| | |
|---|---|
| Citric acid | 1.9212 |
| Boric acid | 0.6184 |
| $H_2O_2$ (Albone 35 CG-35% stabilized) | 17.14 |
| Nonyl phenol + 9.5 EO | 3.00 |
| Perfume | 0.15 |
| Glycine | 0.10 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The above formulation was prepared using the procedure of Example I and had a pH of 2.2. Furthermore, when tested using the accelerated stability test of Example I at a temperature of 100° C., the product has not changed color or degraded the perfume and brightener for 1 day, and the hydrogen peroxide loss was less than 5%, indicating that the shelf stability of the formula will be about 12 months.

EXAMPLE XIII

The following bleach formulation was prepared:

| | |
|---|---|
| DL methionine | 0.500 |
| Adipic acid | 0.2500 |
| $H_2O_2$ (Albone 35 CG-35% stabilized) | 17.14 |
| Nonyl phenol + 9.5 EO | 3.00 |
| Perfume | 0.1500 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.1000 |
| Tinopal SWN (CI Fluorescent Brightener 140) | 0.0500 |
| Deionized water | qs to 100% |

The above formulation was prepared using the procedure of Example I and had an initial pH of 2.28. When tested for $H_2O_2$ content, pH and color after storage at a temperature of 23° C., for one year. The composition had 5.78% $H_2O_2$, a pH of 3.4 and a blue color similar to a fresh sample. Further, the brighteners are still present and the perfume had not degraded.

EXAMPLE XIV

The following bleach formulation was prepared:

| | |
|---|---|
| DL methionine | 0.500 |

-continued

| | |
|---|---|
| Adipic acid | 0.2500 |
| $H_2O_2$ (Albone 35 CG-35% stabilized) | 17.14 |
| Nonyl phenol + 9.5 EO | 3.00 |
| Perfume | 0.1500 |
| Tinopal CBS (CI Fluorescent Brightener 35) | 0.100 |
| Tinopal SWN (CI Fluorescent Brightener 140) | 0.05 |
| Deionized water | qs to 100% |

The above formulation was prepared using the procedure of Example I and had a pH of 2.3. This formula is stable over a period of 12 months showing little loss of $H_2O_2$ or optical brighteners. Also, the perfume had not degraded.

EXAMPLE XV

The following bleach formulation was prepared:

| | |
|---|---|
| Glycine | 0.50 |
| Adipic acid | 0.250 |
| $H_2O_2$ (Albone 35 CG-35% stabilized) | 17.14 |
| Nonyl phenol + 9.5 EO | 3.00 |
| Perfume | 0.150 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.100 |
| Tinopal SWN (CI Fluorescent Brightener 140) | 0.050 |
| Deionized water | qs to 100% |

The above formulation was prepared using the procedure of Example I and had a pH of 2.4. After storage at a temperature of 23° C. for one year, the composition showed a less than 5% loss in hydrogen peroxide and had brighteners present. The color and perfume were similar to a freshly prepared sample.

EXAMPLE XVI

The following bleach formulation was prepared:

| | |
|---|---|
| DL methionine | 0.400 |
| Adipic acid | 0.3500 |
| $H_2O_2$ (Albone 35 CG-35% stabilized) | 17.14 |
| Nonyl phenol + 9.5 EO | 3.00 |
| Perfume | 0.150 |
| Polar Brilliant Blue GAW Crude (CI Acid Blue 127-1) | 0.001974 |
| Chloramine Brilliant Violet B Concentrate (CI Direct Violet 9) | 0.000165 |
| Tinopal CBS (CI Fluorescent Brightener 35) | 0.100 |
| Tinopal SWN (CI Fluorescent Brightener 140) | 0.0500 |
| Deionized water | qs to 100% |

The above formulation was prepared using the procedure of Example I and had an initial pH of 2.28. After storage at 23° C. for one year, the composition contained 5.78% hydrogen peroxide and had a pH of 3.40. Brighteners were still present; however, the color had changed slightly from a freshly prepared sample. Also, the perfume had not degraded.

EXAMPLE XVII

The following bleach formulation was prepared:

| | |
|---|---|
| DL methionine | 0.300 |
| Adipic acid | 0.4500 |
| $H_2O_2$ (Albone 35 CG-35% stabilized) | 17.14 |
| Nonyl phenol + 9.5 EO | 3.00 |
| Perfume | 0.1500 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.1000 |
| Tinopal SWN (CI Fluorescent Brightener 140) | 0.0500 |
| Deionized water | qs to 100% |

The above formulation was prepared using the procedure of Example I and had a pH of 2.28. The composition was stored for one year at 23° C. The composition had 5.88% hydrogen peroxide and contained brighteners although at a lower level than Example XIII. The color had changed to a light pink. The perfume had not degraded.

EXAMPLE XVIII

The following bleach formulation was prepared:

| | |
|---|---|
| DL methionine | 0.100 |
| Adipic acid | 0.65 |
| $H_2O_2$ (Albone 35 CG-35% stabilized) | |
| Nonyl phenol + 9.5 EO | 3.00 |
| Perfume | 0.1500 |
| Tinopal CBS (CI Fluorescent Brightener 35) | 0.1000 |
| Tinopal SWN (CI Fluorescent Brightener 140) | 0.0500 |
| Deionized water | qs to 100% |

The above formulation was prepared using the procedure of Example I and had a pH of 2.2. After storage at 23° C. for one year, the composition contained 5.85% hydrogen peroxide and contained a reduced, though effective, amount of brighteners. The perfume had not degraded.

EXAMPLE XIX

The following formulation was prepared:

| | |
|---|---|
| DI methionine | 0.75 |
| $H_2O_2$ (Albone 35 CG-35% stablized) | 17.14 |
| Perfume | 0.05 |
| Nonyl phenol + 9.5 EO | 1.32 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Calcofluor White SD | 0.05 |
| Deionized water | qs to 100% |

The composition has a pH of 5.0 and is stable on storage. The composition does not need added acid because of the amount of DL methionine present in the composition.

COMPARATIVE EXAMPLE I

The following formula was prepared:

| | |
|---|---|
| Adipic acid | 0.75 |
| Nonyl phenol + 9.5 EO | 3.00 |
| $H_2O_2$ (Albone 35 CG-35% stabilized) | 17.14 |
| Perfume | 0.05 |
| Polar Brilliant Blue GAW Crude (CI Acid Blue 127-1) | 0.001794 |
| Chloramine Brilliant Violet B Concentrate (CI Direct Violet 9) | 0.000165 |
| Tinopal CBS (CI Fluorescent Brightener 35) | 0.10 |
| Tinopal SWN (CI Fluorescent Brightener 140) | 0.05 |
| Deionized water | qs to 100% |

The composition has a pH of 3.2 and is not stable. All dyes and perfumes are degraded within 1 week storage at room temperature.

I claim:

1. A stable aqueous bleach composition comprising:

(a) from 2–12% by weight hydrogen peroxide;

(b) from 0–20% by weight of an acid selected from the group consisting of an organic acid, phosphoric acid, boric acid or mixtures thereof;

(c) from 0.05–10.0% by weight of at least one alpha-amino acid;

(d) from 0.0001–1% by weight of a compound selected from the group consisting of a dye, an optical brightener or mixtures thereof; and (e) water;

the weight ratio of hydrogen peroxide to alpha-amino acid is within the range of from 1:0.003–1:1.5 and with the proviso that the composition contains sufficient organic acid to bring the pH of the composition to within the range of from about 1.8–5.5.

2. The composition of claim 1 wherein the alpha-amino acid is present in an amount of from 0.1 to 7.5% by weight.

3. The composition of claim 1 wherein the alpha-amino acid is present in an amount of from 0.5–1.5% by weight.

4. The composition of claims 1 or 2 or 3 wherein the alpha-amino acid is methionine, glycine or mixtures thereof.

5. The composition of claim 1 wherein the acid is present in an amount of from 0.1–12% by weight and wherein the weight ratio of hydrogen peroxide to acid is within the range of 1:0.01–1:4.

6. The composition of claim 1 wherein the acid is present in an amount of from 0.50–8% by weight and wherein the weight ratio of hydrogen peroxide to acid is within the range of 1:0.01–1:4.

7. The composition of claims 1 or 5 or 6 wherein the acid is selected from the group consisting of adipic acid, phthalic acid, citric acid, boric acid or mixtures thereof.

8. The composition of claims 1 or 5 or 6 wherein the acid is adipic acid.

9. The composition of claim 1 wherein the hydrogen peroxide is present in an amount from 2–8% by weight.

10. The composition of claim 1 wherein the hydrogen peroxide is present in an amount from 2–6% by weight.

11. A stable aqueous bleach composition comprising:

(a) from 2–8% by weight hydrogen peroxide;

(b) from 0.1–12% by weight acid selected from the group consisting of an organic acid phosphoric acid, boric acid or mixtures thereof;

(c) from 0.1–7.5% by weight of at least one alpha-amino acid;

(d) from 0.0001–1% by weight of a compound selected from the group consisting of a dye, an optical brightener and mixtures thereof; and (e) water;

wherein the weight ratio of hydrogen peroxide to acid is within the range of from 1:0.01–1:4 and the weight ratio of hydrogen peroxide to alpha-amino acid is within the range of from 1:0.003–1:1.5 and wherein the composition has a pH within the range of from about 1.8–5.5.

12. The composition of claim 11 wherein the alpha-amino acid is present in an amount of from 0.5–1.5% by weight.

13. The composition of claims 11 or 12 wherein the alpha-amino acid is methionine, glycine or mixtures thereof.

14. The composition of claims 11 or 12 wherein the acid is present in an amount of from 0.50%–8% by weight.

15. The composition of claim 14 wherein the acid is selected from the group consisting of adipic acid, phthalic acid, citric acid, boric acid or mixtures thereof.

16. The composition of claim 14 wherein the acid is adipic acid.

17. The composition of claim 11 wherein the hydrogen peroxide is present in an amount from 2–6% by weight.

* * * * *